United States Patent [19]

Knoch

[11] Patent Number: 4,596,288

[45] **Date of Patent: * Jun. 24, 1986**

[54] HEAT RECOVERY DEVICE FOR EXHAUST FLUES

[76] Inventor: Darrell G. Knoch, c/o Miracle Heat, Inc. P.O. Box 81, Gladstone, Mich. 49837

[ * ] Notice: The portion of the term of this patent subsequent to Nov. 5, 2002 has been disclaimed.

[21] Appl. No.: 706,021

[22] Filed: Feb. 27, 1985

Related U.S. Application Data

[63] Continuation-in-part of Ser. No. 480,854, Mar. 31, 1983, Pat. No. 4,550,772.

[51] Int. Cl.[4] ..... F28D 7/00

[52] U.S. Cl. ..... 165/901; 110/210; 122/20 B; 422/200

[58] Field of Search ..... 165/DIG. 2, 901; 110/210; 122/20 B; 422/177, 180, 200, 201

[56] References Cited

U.S. PATENT DOCUMENTS

| | | | |
|---|---|---|---|
| 2,468,909 | 5/1949 | Yeager et al. | 165/DIG. 2 |
| 2,882,023 | 4/1959 | Rizzo | 165/DIG. 2 |
| 3,560,165 | 2/1971 | Beasley | 422/200 X |
| 4,028,817 | 6/1977 | Winstel | 165/DIG. 2 X |
| 4,050,628 | 9/1977 | Konnerth, III | 165/DIG. 2 X |
| 4,147,303 | 4/1979 | Talucci | 165/DIG. 2 X |
| 4,176,709 | 12/1979 | Johnson | 165/99 |
| 4,219,073 | 8/1980 | Talmadge et al. | 165/DIG. 2 X |
| 4,235,286 | 11/1980 | Behlau | 165/DIG. 2 X |
| 4,276,929 | 7/1981 | Howard | 165/DIG. 2 X |
| 4,278,126 | 7/1981 | Skrzypek | 165/122 |
| 4,313,562 | 2/1982 | White | 165/DIG. 2 X |
| 4,330,503 | 5/1982 | Allaire et al. | 422/200 X |
| 4,363,353 | 12/1982 | Pranaitis | 165/39 |
| 4,373,452 | 2/1983 | Van Dewoestine | 422/200 X |

FOREIGN PATENT DOCUMENTS

| | | | |
|---|---|---|---|
| 871937 | 5/1942 | France | 165/DIG. 2 |

*Primary Examiner*—Michael Koczo
*Assistant Examiner*—Randolph A. Smith
*Attorney, Agent, or Firm*—Glenn A. Buse'

[57] ABSTRACT

The heat recovery device includes a section of standard flue pipe carrying a single row of a plurality of hollow, cylindrical heating tubes extending diametrically through the flue pipe section and a separate housing defining an air flow chamber surrounding the portion of the flue pipe section containing the heating tubes. A fan inside the housing draws ambient air into the housing and propels a flow of air toward a heated air outlet, both through the heating tubes and over the outer surface of the flue pipe section. A catalytic combustor for reducing air pollutants and potential creosote deposits is mounted in the flue pipe section upstream of the heating tubes. The flue pipe assembly is removably mounted on the housing so it can be removed in the event it fatigues and/or becomes plugged with carbon or creosote deposits during use. A thermostat on the flue pipe section turns the fan on and off when the temperature in the flue pipe section is respectively above and below a predetermined temperature.

15 Claims, 11 Drawing Figures

Fig. 2.
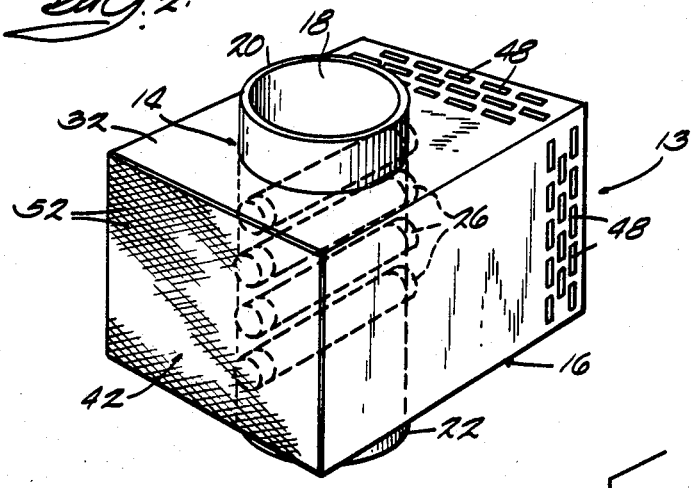
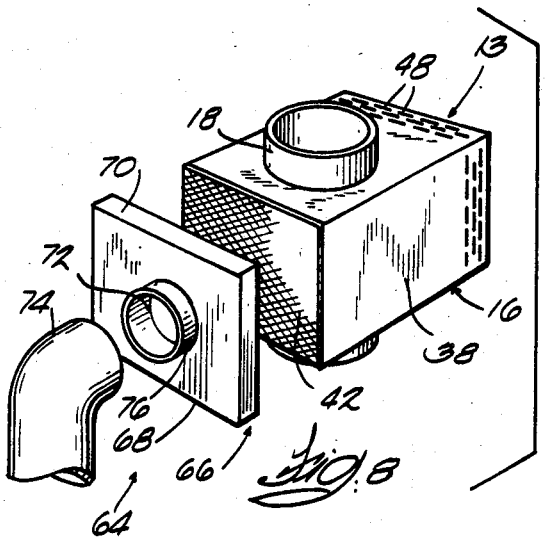
Fig. 8
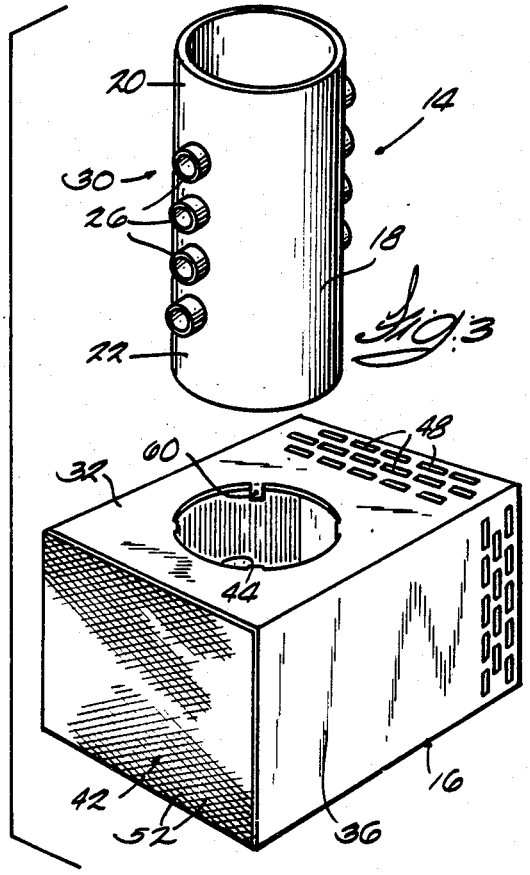
Fig. 3
Fig. 1
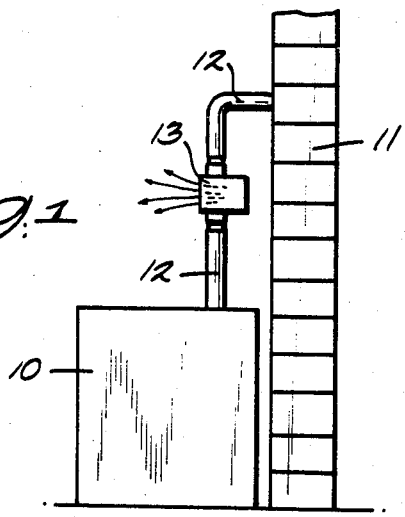

HEAT RECOVERY DEVICE FOR EXHAUST FLUES

CROSS-REFERENCE TO RELATED APPLICATIONS

This is a continuation-in-part of application Ser. No. 480,854, filed Mar. 31, 1983, now U.S. Pat. No. 4,550,772 issued Nov. 5, 1985.

BACKGROUND OF THE INVENTION

This invention relates to heat recovery devices and, more particularly, to devices for recoving heat normally lost from a flue for hot gases from a stove, furnace or the like and recirculating same for use in heating a room or building.

It is well known that the efficiency of furnaces and stoves for heating buildings, particularly those burning fossil fuels and wood, is substantially reduced because of the loss of a large amount of the heat energy in the combustion gases exhausted to the atmosphere through a flue and chimney.

Most modern wood and coal burning stoves are desiged for high efficiency and are substantially air tight so that the only air admitted into the combustion chamber enters through an adjustable draft. This permits combustion to be closely controlled for a more even fire and slower burning. However, the temperature of the combustion gases are somewhat lower than that for older stoves having areas through which uncontrolled amounts of air can enter the combustion chamber. Consequently, when wood is being burned, removal of an excessive amount of heat from the combustion gases as they pass through an exhaust flue can cause the temperature to drop below a point where creosote and/or tars separate and collect on cooled surfaces inside the exhaust flue.

Numerous different types of devices have been proposed for recovering some of the waste heat from the exaust flue and recirculating it directly back into the building or to another part of the heating system. In one type of device, the hot flue gases pass over the outer surfaces of a plurality of transversely extending heating tubes. Ambient air passing through these tubes, either by natural flow or propelled by a blower, is heated and recirculated back into the room. Examples of this type device are disclosed in U.S. Pat. Nos. 2,882,023 (Rizzo), issued Apr. 14, 1959, 4,028,817 (Winstel), issued June 14, 1977, 4,176,709 (Johnson), issued Dec. 4, 1979, 4,235,286 (Behlau), issued Nov. 25, 1980 and 4,363,353 (Pranatis), issued Dec. 12, 1982.

This type device typically includes a relatively large number of small heating tubes which can cause a significant cooling of the flue gases. When a wood containing tars or creosote is being used as the fuel, the flue gases can be cooled to the point where these tars or creosote separate and collect as deposits on the outer surfaces of the heating tubes and the interior of the flue. Such deposits are flammable and can cause hazardous chimney fires. Carbon or soot can also deposit on the heating tubes when fossil fuels and other types of wood are being burned. Both type of deposits can severely restrict the flow of the flue gases and create the potential hazard of the exhaust gases backing up into a room, resulting in asphyziation.

In another type device, air is heated as it passes through a housing surrounding the exhaust flue. Examples of this type device are disclosed in U.S. Pat. Nos. 2,468,909 (Yeager et al.), issued May 3, 1949, and 4,278,126 (Skrzypek), issued July 14, 1981, 4,147,303 (Talucci), issued Apr. 3, 1979, and 4,313,562 (Wite), issued Feb. 2, 1982. This type device usually is substantially less efficient in recovering the waste heat.

Examples of other types heat recovery devices are disclosed in U.S. Pat. No. 4,276,929 (Howard), issued July 7, 1981, and French Pat. No. 871,937, published May 22, 1942. The device disclosed in the first patent is quite complicated and bulky and requires a relatively large outer chamber including a baffling system for directing air in opposite directions through two different sections of transversely extending heating tubes in an inner chamber through which the flue gases pass. In the device disclosed in the latter patent, the gases flow through a chamber surrounding an ambient air duct and also through a pipe extending transversely through the air duct.

Prior devices known to applicant including heating tubes arranged for air to pass transversely through the flue gases and some kind of fan or blower to improve heat recovery and recirculation of the recovered heat are relatively complex and require some modification to the existing flue system, making them relatively expensive to manufacture and difficult to install. Also, they are arranged so that, in the event the portion through which the flue gases flow fatigues and/or becomes plugged with carbon or creosote deposits during use, the entire unit must be replaced.

SUMMARY OF THE INVENTION

An object of the invention is to provide a simple device for efficiently recovering and recirculating heat normally lost from the exhaust flue of a stove, furnace or the like without creating a safety hazard, particularly when wood is burned.

Another object of the invention is to provide such device which is inexpensive to manufacture and convenient to install in an existing flue system.

A further object of the invention is to provide such a device having a flue pipe section for heating air passing through tubes extending transversely through the flue pipe section and a separate housing defining a chamber for heating air flowing around and over the outer surface of the flue pipe section.

A still further object of the invention is to provide a heat recovery device described in the next preceding paragraph wherein the flue pipe section is removably mounted on the housing so it can be conveniently replaced in the event it fatigues and/or becomes plugged with carbon or creosote deposits during use.

A yet further object of the invention is to provide a heat recovery device for wood and coal burning stoves including means for reducing separation of creosote and/or tar from and air pollutants in the exhaust gases.

Other objects, aspects and advantages of the invention will become apparent to those skilled in the art upon reviewing the following detailed description, the drawing and the appended claims.

The heat recovery device provided by the invention includes a section of cylindrical flue pipe adapted for connection to the existing flue, a plurality of heating tubes disposed in a single axially extending row and extending diametrically through the flue pipe so that the hot flue gases flow over the outer surfaces thereof, a housing which defines an air flow chamber surrounding a portion of the flue pipe section containing the heating tubes, which has an air inlet and which has a heated air outlet, and fan means inside the housing for drawing ambient air into the housing through the air inlet and propelling a flow of air toward the heated air outlet, both through the heating tubes and over the outer surface of the flue pipe section.

The total outer surface area of the heating tubes and the portion of the flue pipe section inside the housing is such that the heat extracted from the combustion gases by natural flow of air through the heating tubes and over the outer surface of the flue pipe section does not reduce the temperature below a point where significant amounts of creosote and/or tars separate therefrom when wood is burned. The flue pipe section preferably is removably mounted on the housing so it can be removed and replaced in the event it fatigues and/or becomes plugged with carbon or creosote deposits during use.

In one embodiment, the heating tubes are disposed in a single axially extending row and extend diametrically through the flue pipe section in axially spaced, parallel relationship in order to minimize resistance to the flow of flue gases through the flue pipe section.

In one embodiment, a temperature sensing means is provided for turning the fan means off and on when the temperature of the flue pipe section is respectively above and below a predetermined level. The total open area of the air inlet and the air outlet preferably is large enough so that, in the event the fan means is inoperative, the natural flow of ambient air through the heating tubes and over the outer surface of the flue pipe is sufficient to prevent the flue pipe section from overheating.

In one embodiment, a disc-shaped catalytic combustor is mounted inside the flue pipe section upstream of the heating tubes for rotational movement between a starting position generally parallel to the flow of combustion gases and an operating position generally perpendicular to the flow of combustion gases.

BRIEF DESCRIPTION OF THE DRAWING

FIG. 1 is a schematic view illustrating the heat recovery device of the invention installed in the flue of a wood burning stove.

FIG. 2 is a perspective view of the heat recovery device apart from the stove and flue.

FIG. 3 is an exploded, perspective view of the heat recovery device shown with the flue pipe assembly removed from the housing.

FIG. 8 is an exploded, perspective view of the heat recovery device and an auxiliary hot air flow director adapted to fit over the front of the housing for directing heated air to a remote location.

DESCRIPTION OF THE PREFERRED EMBODIMENTS

Figure 4:
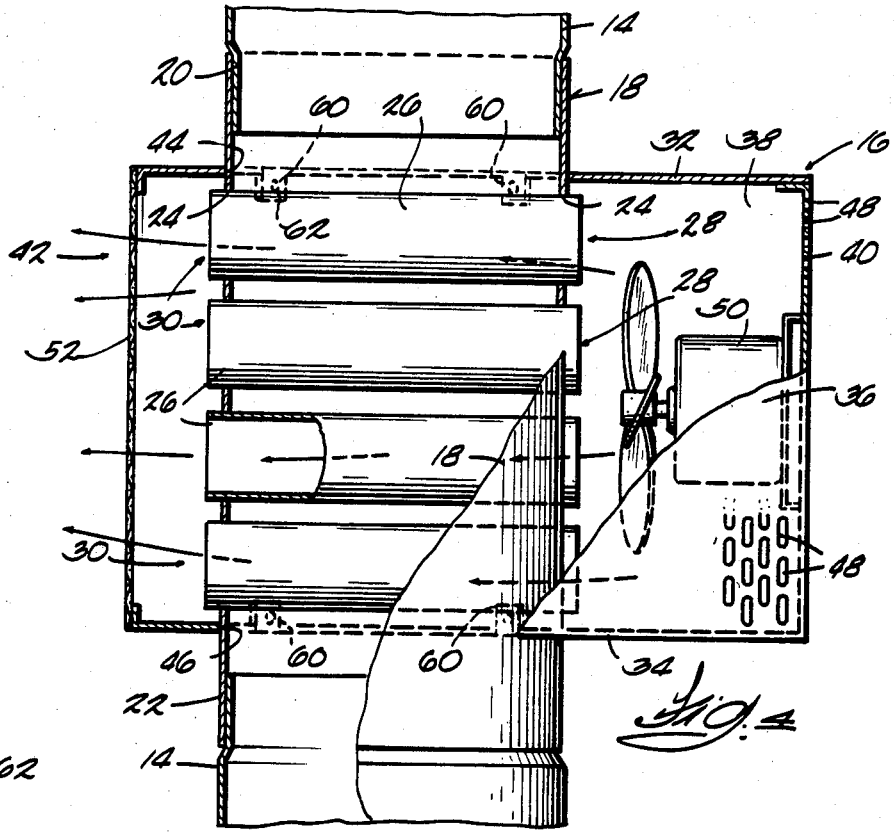
FIG. 4 is an enlarged, partially broken away, side elevation view of the heat recovery device shown installed like in FIG. 1.
Figure 7:
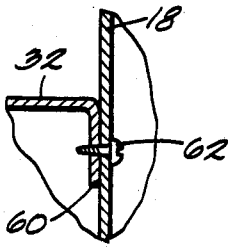
FIG. 7 is an enlarged, fragmentary, sectional view taken generally along line 7—7 in FIG. 6.
Figure 5:
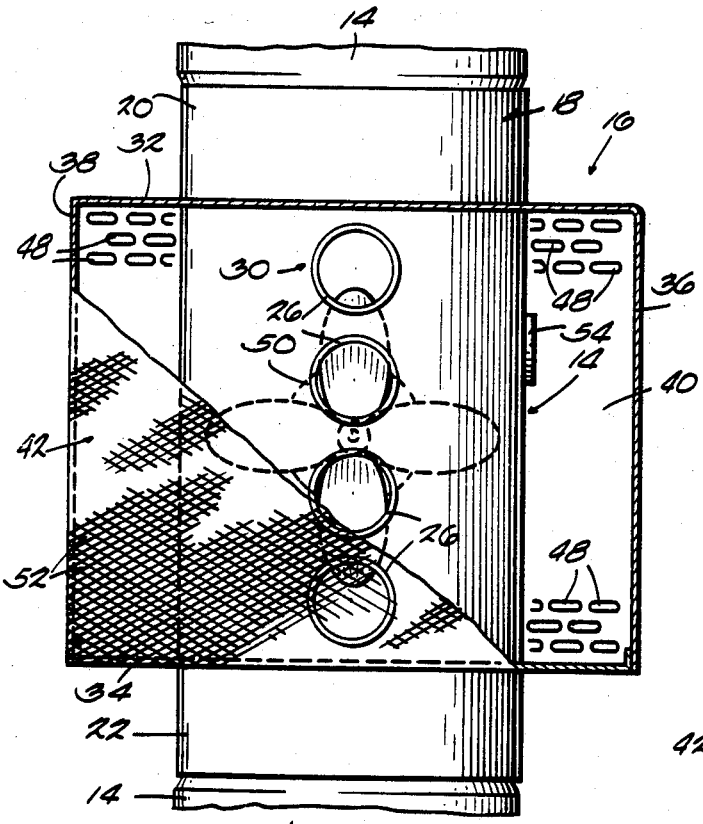
FIG. 5 is an enlarged, partially broken away, front elevation view of the heat recovery device shown installed like in FIG. 1.
Figure 6:
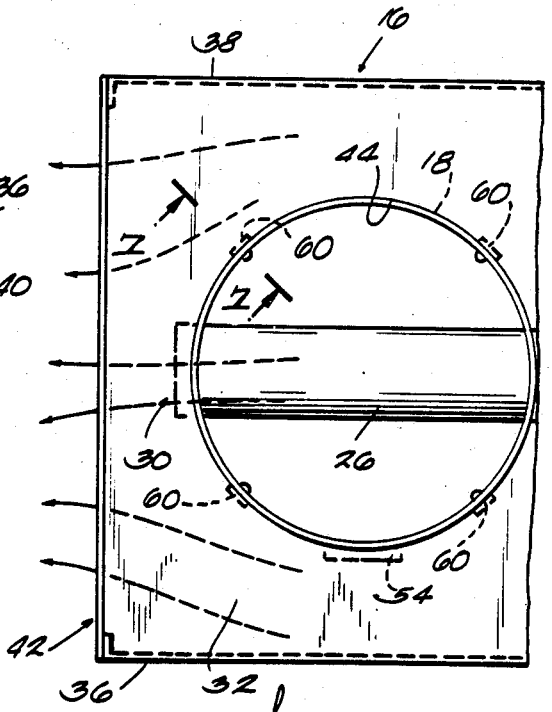
FIG. 6 is an enlarged, fragmentary, top plan view of the heat recovery device.

The heat recovery device of the invention can be adapted for use in exhaust flues of a wide variety of heating devices including fuel burning stoves and furnaces and the like. It is particularly adapted for use with substantially air tight, high efficiency wood and coal burning home heating stoves and will be described in connection with the application.

Illustrated in FIGS. 1–7 is a high efficiency wood burning stove 10 connected to a chimney 11 by standard 6- or 8-inch stove flue pipe 12. The heat recovery device 13 of the invention includes two separate subassemblies, a flue pipe assembly 14 which fits into the existing flue pipe 12 and a housing 16 which encircles and defines an air flow chamber surrounding a portion of the flue pipe assembly 14.

The flue pipe assembly 14 includes a section 18 of standard metal flue pipe of the same diameter as the existing flue pipe 12. Thus, the opposite ends 20 and 22 of the flue pipe section 18 can be slipped over the ends of the existing flue pipe 12 and the hot combustion gases from the stove 10 flow through the interior of the flue pipe section 18 enroute to the chimney 11.

The flue pipe section 18 (FIG. 4) includes a plurality of axially spaced, diametrically opposed, circular apertures 24, each of which receive a hollow, cylindrical heating tube 26. The heating tubes 26 are made from a heat conductive material, such as metal, and ambient air passing through the interior is heated by the combustion gases flowing over the outer surfaces thereof. Air enters inlet ends 28 of the heating tubes 26 and exits through the opposite discharge ends 30.

The outside diameter of the heating tubes 26 preferably is approximately the same as the diameter of the apertures 24 so there is substantially a press fit between the heating tubes 26 and the apertures 24 to provide a gas tight seal. Although not essential for most applications, the heating tubes 26 can be brazed or otherwise bonded to the flue pipe section 18 around the apertures 24 in order to provide a further gas seal. The heating tubes 26 can be slightly longer than the outside diameter of the flue pipe section 18 so that the opposite ends extend a small distance (e.g., ½ inch) past the outer surface of the flue pipe section 18.

A relatively small number of heating tubes 26 is used in order to minimize restriction to the flow of combustion gases through the flue pipe section 18 and to prevent extraction of an excessive amount of heat from the combustion gases by natural flow of ambient air through the heating tubes 26 as explained in more detail below. Prior art heat recovery devices having a relatively large number of heating tubes, because of the large total surface area exposed to the combustion gases, can extract enough heat from the combustion gases by the natural flow of air through the heating tubes to cause the temperature to drop to a point (e.g., about 250°–300° F.) where creosote separates and collects as a deposit on the heating tubes and the interior of the flue pipes. The number of tubes depends upon their diameter and the length and diameter of the flue pipe section 18. Generally, 6 or less heating tubes usually are used.

In the specific instruction illustrated, the flue pipe section 18 is cut from a standard 6-inch diameter, 24 gauge galvanized metal flue pipe, there are four heating tubes 26, and the heating tubes 26 are made from a thin metal and have a 1½ inch diameter. As a guide, the flue pipe section 18 can be approximately 12 inches long.

While the heating tubes 26 can be disposed in different arrays in the flue pipe section 18, the apertures 24 preferably are formed so that the heating tubes 26 are parallel to each other, extend diametrically through the center line or longitudinal axis of the flue pipe section 18 and are axially aligned in a single row. This further minimizes interference with the flow of combustion gases through the interior of the flue pipe section 18. That is, in the event there is any build-up of carbon or creosote deposits on the outer surfaces of the heating tubes 26, only that on the opposite sides of the tubes will cause a reduction in the internal flow area of the flue pipe section 18. Any build-up on the tops and bottoms of the heating tube 26 and between the heating tubes 26 does not affect the flow area.

The housing 16 includes opposed top and bottom walls 32 and 34, opposed side walls 36 and 38, a back wall 40 and a front 42. While other configurations can be used, in the specific construction illustrated, the housing 16 is generally rectangular and, as a guide, can be 10 inches wide, 12 inches long and 8 inches tall. The top and bottom walls 32 and 34 include opposed circular apertures 44 and 46 for receiving the flue pipe section 18 and cooperate with the back wall 40 and the side walls 36 and 38 to define an air flow chamber surrounding the flue pipe section 18.

The top, bottom, side and rear walls of the housing 16 preferably are made from a relatively thin, light weight material, such as 24 gauge galvanized metal. While the top, bottom, side and rear walls can be separate parts, in the preferred construction illustrated, the bottom wall 34 and the back wall 40 are bent from one piece of material and the top wall 32 and the side walls 36 and 38 are bent from one piece. These two pieces are fastened together by suitable means such as metal screws (not shown) or the like.

The rear portions of the top wall 32, the bottom wall 34, the side walls 36 and 38, and the rear wall 40 include a plurality of openings 48 which serve as an inlet for admitting ambient air into the housing 16 on the same side of the flue pipe section 18 as the inlet ends 28 of the heating tubes 26. In the specific instruction illustrated, the air inlet openings 48 are in the form of elongated slots. These openings can be in the form of louvers pressed into the sheet metal to improve the air flow and structural integrity.

A fan 50 mounted inside the housing 16 on the back wall 40 draws ambient air through the inlet openings 48 into the housing 16 and propels a flow of air both through the heating tubes 26 and over the outer surface of the flue pipe section 18 toward the front 42 of the housing 16. The front 42 includes a plurality of openings 52 through which the heated air exiting from the discharge ends 30 of the heating tubes 26 and flowing around the flue pipe section 18 is discharged from the housing 16. While various arrangements can be used, in the specific construction illustrated, the front 42 is covered by an expanded metal type grating.

Mounted on the flue pipe section 18 inside the housing 16 is a temperature sensing means, such as a bi-metallic thermostat 54, which is operatively connected to the fan 50 to turn the fan 50 on when the temperature of the flue pipe section 18 reaches a predetermined level (e.g., 120°–145° F.) and to turn the fan 50 off when that temperature falls below the predetermined level. This temperature corresponds to a temperature of the combustion gases above the point where creosote separates therefrom when wood is being burned. Thus, the fan 50 does not operate unless the stove 10 is burning fuel and the flue pipe section 18 is hot enough to provide auxiliary eating and the temperature of the combustion gases is above a point where heat extracted by the propelled flow of air through the heating tubes 26 and over the outer surface of the flue pipe section 18 does not cause separation of significant amounts of creosote and/or tars from the combustion gases when wood is being burned.

The total area of the ambient air inlet openings 48 and the heated air outlet openings 52 is large enough so that, in the event the fan 50 becomes inoperative because of power outage or the like, the natural flow of ambient air through the heating tubes 26 and over the outer surface of the flue pipe section 18 is sufficient to prevent the flue pipe section from overheating.

The flue pipe section 18 preferably is removably mounted on the housing 16 so that, in the event the flue pipe assembly 14 fatigues and/or becomes partially plugged with carbon or creosote deposits during use, it can be removed and replaced with a new one. In the specific construction illustrated, the top wall 32 and the bottom wall 34 are provided with a plurality of inturned, axially extending tabs 60 circumferentially spaced around the perimeter of the apertures 44 and 46. The flue pipe section 18 (FIG. 7) is removably fastened to the tabs 60 by metal screws 62 extending trough the flue pipe section 18 and threaded into the tabs 60.

FIG. 8 illustrates a hot air flow director 64 which can be slipped over the front 42 of the housing 16 when it is desired to direct the heated air to a specific remote area, such as the hot air duct of a forced air home heating system. The flow director 64 includes a box-like adapter 66 having a cover 68 for covering the front 42 of the housing 16 and a peripheral flange 70 which slips over the front edges of the top, bottom and side walls. The cover 68 includes a sleeved, central outlet port 72 of approximately the same diameter as the flue pipe section 18. One end of an air duct 74, such as a standard flue pipe or a flexible hose, fits over the port sleeve 76 in communication with the outlet port 72 and the other end is located in a remote area where additional heat is desired or connected to the hot air duct of the home heating system.

Figure 9:
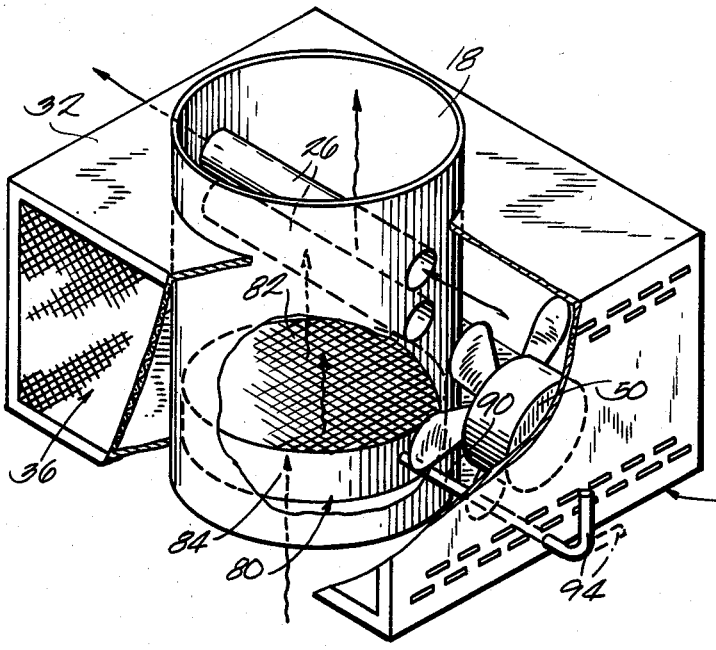
FIG. 9 is a perspective view, partially broken away, of another embodiment of the heat recovery device including a catalytic combustor, shown with the catalytic combustor in the operating position.
Figure 11:
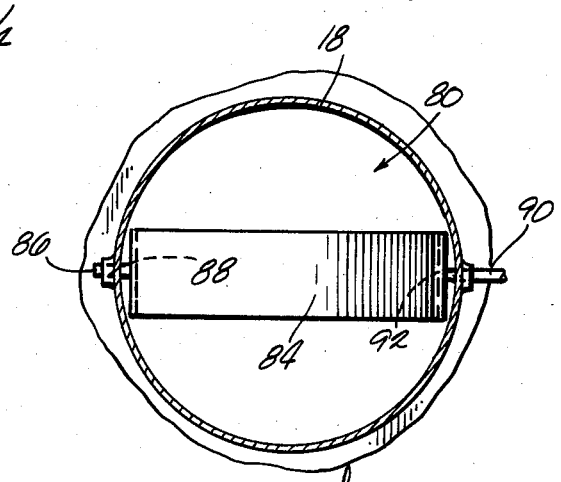
FIG. 11 is a cross sectional taken above the catalytic combustor with the catalytic combustor in the starting position.
Figure 10:
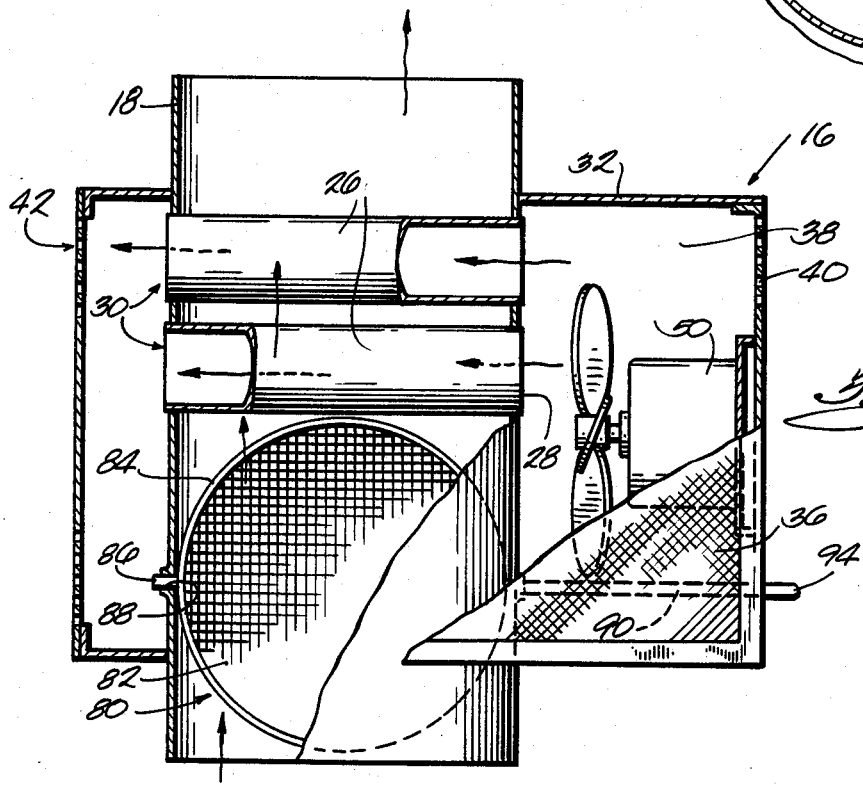
FIG. 10 is a side elevational view, partially broken away of the heat recovery device shown in FIG. 9, shown with the catalytic combustor in the starting position.

FIGS. 9–11 illustrate an alternate embodiment including a catalytic combustor for reducing accumulation of creosote in the flue and chimney and reducing air pollutants in the combustion gases. Components common with the embodiment illustrated in FIGS. 1–8 have been assigned the same reference numerals.

In this embodiment, a number (e.g. 2) of the heating tubes 26 are replaced with a conventional disc-shaped catalytic combustor 80 including a circular ceramic base 82 having a honeycomb or cellular structure coated with a noble metal such a palladium or platinum. The ceramic base 82 is surrounded by a stainless steel band 84. As a guide, the catalytic combustor 80 can be about 1½ inch thick and have an outside diameter of 1 inch or so less than the inside diameter of the flue pipe section 18.

The catalytic combustor 80 is mounted inside the flue pipe section 18 upstream of the heating tubes 28 by a stub rod 86 mounted on the band 84 and extending through an aperture 18 in the flue pipe section 18 and a longer rod 90 mounted on the band 84 diametrically opposite to the stub rod 86 and extending through an aperture 92 in the flue pipe section 18. Located on the outer end of the rod 90 is an operating handle 94 for rotating the catalytic combustor 80 between a starting position generally parallel to the flow of combustion gases through the flue pipe section 18 as illustrated in FIGS. 10 and 11 and an operating position generally perpendicular to the flow of combustion gases as illustrated in FIG. 9.

The uncombusted smoke in the combustion gases from the burning wood contain particulate and gaseous hydrocarbon pollutants. Many of these hydrocarbons are combustible, but ordinarilly require a temperature in the order of 1000°-1500° F. to burn. As alluded to above, the temperature of combustion gases from burning wood in a modern, high efficiency stove is substantially below this level. When activated, the ceramic base 82 reduces the ignition temperature of the uncombusted hydrocarbons to about 500°-600° F. so that a substantial portion is burned. Burning these smoke-producing hydrocarbons reduces air pollution and increases the temperature of the combustion gases, thereby reducing the danger of creosote separating from the combustion gases and accumulating in the flue and the chimney.

The ceramic base 82 for the catalytic combustor 80 is of conventional design. Suitable ceramic bases are commercially available from Applied Ceramics, Atlanta, Georgia, Corning Glass Works, Corning, New York and Nu-Tec, Inc., East Greenwich, R.I. Different ceramic bases are used with wood and coal.

When a fire is first started in the stove, the catalytic combustor 80 should be in the starting position illustrated in FIGS. 10 and 11. The stove damper or draft (not shown) is opened to provide a medium-to-high burn. Once the temperature of the ceramic base 80 reaches approximately 500°-600° F., the catalyst becomes activated and the catalytic combustor 80 can be moved to the operating position shown on FIG. 9. Smoke subsequently passing through the cells of the ceramic base 82 is burned. The stove damper then can be moved to a desired position for long term heating. If the fire gets low before refueling, it may be necessary to reactivate the catalytic combustor 80 with a medium-to-high burn after refueling.

Additional heat produced by burning the smoke-producing hydrocarbons increases the temperature of the combustion gases inside the flue pipe section of 18. The fan 50 operates in the manner described above. Air blown over the outer surface of the flue pipe section 18 is warmed by heat radiating through the flue pipe section 18 and air blown through the heating tubes 26 extracts heat from the combustion gases. The heat recovery device of this embodiment usually is capable of recovering more heat than the embodiment illustrated in FIGS. 1-8 even though it has fewer heating tubes.

Although only two heating tubes 26 are shown, a larger number can be used by increasing the length of flue pipe section 18 and the height of the housing 16. However, the number of heating tubes 26 and the length of the flue pipe section 18 inside the housing 16 are limited by the constraint discussed above with respect to the heat extracted from the combustion gases by natural flow of ambient air after the fan 50 has been turned off by the thermostat 54. When this occurs, the temperature of the combustion gases is below the activation temperature of the catalytic combustor. Thus, the smoke is no longer burned and there is no increase in the temperature of the combustion gases. Consequently, if the total heating surface of the heating tubes 26 and the portion of the flue pipe section 18 inside the housing 16 is too large, enough heat can be extracted from the combustion gases to cause creosote to separate.

From the foregoing description, one skilled in the art can easily ascertain the essential characteristics of the invention and, without departing from the spirit and scope thereof, make various changes and modifications to adapt it to various usages.

What is claimed is:

1. A device for recovering and recirculating heat normally lost from the exhaust flue of a stove, furnance or the like having a cylindrical flue, said device including a section of cylindrical flue pipe which has opposite ends adapted for connection to the existing flue, which has an inside diameter substantially the same as that of the existing cylindrical flue and through which the hot flue gases flow;

a plurality of heating tubes extending diametrically through said flue pipe section so that the hot flue gases flow over the outer surfaces thereof, said heating tubes having opposite air inlet and discharge ends and being disposed in a single row;

a housing defining an air flow chamber surrounding the portion of said flue pipe section containing said heating tubes, said housing having an ambient air inlet on the same side of said flue pipe section as the inlet ends of said heating tubes and a heated air outlet on the same side of said flue pipe section as the discharge ends of said heating tubes;

fan means inside said housing for drawing ambient air into said housing through said air inlet and propelling a flow air toward said heated air outlet, both through said heating tubes and over the outer surface of said portion of said flue pipe section; and a disc-shaped catalytic combustor mounted inside said flue pipe section upstream of said heating tubes for rotational movement between a starting position generally parallel to the flow of flue gases and an operating position generally perpendicular to the flow of the flue gases.

2. A device according to claim 1 wherein the total outer surface area of said heating tubes and said portion of said flue pipe section is such that the heat extracted from the flue gases by the natural flow of ambient air through said heating tubes and over said portion of said flue pipe section does not reduce the temperature of the flue gases below a point where significant amounts of creosote separates therefrom when wood is being burned.

3. A device according to claim 2 wherein said heating tubes are disposed in axially spaced, parallel relatioship.

4. A device according to claim 2 wherein said flue pipe section is removably mounted on said housing.

5. A device according to claim 4 wherein said housing includes a pair of opposed walls, each having an aperture for receiving said flue pipe section, and a plurality of axially extending tabs circumferentially spaced tabs around the perimeter of said aperture; and said flue pipe section is mounted on said housing by fastening means removably fastening said flue pipe section to said tabs.

6. A device according to claim 5 wherein said fastening means comprise screws extending through said flue pipe section and threaded into said tabs.

7. A device according to claim 2 icluding temperature sensing means for turning said fan means on and off when the temperature of said flue pipe section is respectively above and below a predetermined level.

8. A device according to claim 7 wherein said predetermined temperature corresponds to a temperature of the flue gases above the point where significant amounts of creosote separates from the flue gases when wood is being burned.

9. A device according to claim 2 wherein the total open area of said ambient air inlet and said heated air outlet is large enough so that, in the event said fan means is inoperative, the natural flow of ambient air through said heating tubes and over the outer surface of said flue pipe section is sufficient to prevent said flue pipe section from overheating.

10. A device according to claim 2 wherein said flue pipe section is made from a standard sheet metal flue pipe.

11. A device according to claim 2 wherein said housing has a front end including said heated air outlet; and said device further includes a heated air flow director comprising an adapter including a cover for covering said heated air outlet and having a peripheral flange adapted to fit over said housing front end, an outlet port in said cover, and a duct having one end connected in communication with said outlet port and adapted to direct heated air from said housing to a remote location.

12. A device according to claim 1 wherein said catalytic combustor includes a base having a honeycomb structure and cells coated with a noble metal.

13. A device for recovering and recirculating heat normally lost from the exhaust flue of a stove, furnace or the like having a cylindrical flue, said device including a section of flue pipe which has opposite ends adapted for connection to the existing flue and through which the hot flue gases flow;

a plurality of heating tubes extending diametrically through said flue pipe section in axially spaced, parallel relationship in a single axially extending row so that the hot flue gases flow over the outer surfaces thereof, said heating tubes having opposite air inlet and discharge ends;

a housing having opposed walls including coaxial apertures receiving said flue pipe section and defining an air flow chamber surrounding the portion of said flue pipe section containing said heating tubes, said housing having an ambient air inlet on the same side of said flue pipe section as the inlet ends of said heating tubes and an heated air outlet on the same side of said flue pipe section as the discharge ends of said heating tubes;

means for removably mouting said flue pipe section on said housing;

fan means inside said housing for drawing ambient air into said housing through said air inlet and propelling a flow air toward said heated air outlet, both through said heating tubes and over the outer surface of said portion of said flue pipe section; and a disc-shaped catalytic combustor mounted inside said flue pipe section upstream of said heating tubes for rotational movement between a starting position generally parallel to the flow of the flue gases and an operating position generally perpendicular to the flow of flue gases.

14. A device according to claim 13 wherein the total outer surface area of said heating tubes and said portion of said flue pipe section is such that the heat extracted from the flue gases by natural flow of ambient air through said heating tubes and over said portion of said flue pipe section does not reduce the temperature of the flue gases below a point where significant amounts of creosote separate therefrom when wood is being burned.

15. A device according to claim 13 wherein said catalytic combustor includes a base having a honeycomb structure and cells coated with noble metal.

* * * * *